US005346739A

United States Patent [19]

Nassoiy

[11] Patent Number: 5,346,739

[45] Date of Patent: Sep. 13, 1994

[54] VOID LABEL

[75] Inventor: Gary J. Nassoiy, West Norwood, Mass.

[73] Assignee: Moore Business Forms, Inc., Grand Island, N.Y.

[21] Appl. No.: 59,276

[22] Filed: May 11, 1993

[51] Int. Cl.[5] ..... B42D 15/00

[52] U.S. Cl. ..... 428/40; 281/2; 283/81; 283/101; 283/108; 428/41; 428/42; 428/43; 428/77; 428/137; 428/138; 428/212; 428/195; 428/220; 428/354; 428/355; 428/481; 428/535; 428/916

[58] Field of Search ..... 428/40, 41, 42, 195, 428/212, 220, 535, 481, 916, 43, 137, 138, 214, 194, 77, 354, 355; 283/81, 108, 101, 72; 40/299, 310; 462/17; 281/2

[56] References Cited

U.S. PATENT DOCUMENTS

| | | | |
|---|---|---|---|
| 4,379,573 | 4/1983 | Lomeli et al. | 428/42 |
| 4,652,473 | 3/1987 | Han | 428/35 |
| 4,799,712 | 1/1989 | Biava et al. | 282/1 A |
| 4,876,123 | 10/1989 | Rivera | 428/34.2 |
| 4,932,684 | 6/1990 | Vermeulen | 283/81 |
| 4,941,196 | 7/1990 | Edelman et al. | 383/5 |
| 4,951,970 | 8/1990 | Burt | 283/67 |
| 4,983,438 | 1/1991 | Jameson | 283/81 |
| 5,019,436 | 5/1991 | Schramer et al. | 428/40 |
| 5,082,702 | 1/1992 | Alband | 428/36.92 |
| 5,084,143 | 1/1992 | Smith | 205/112 |
| 5,090,942 | 2/1992 | Traise | 462/66 |
| 5,098,759 | 3/1992 | Felix | 428/42 |
| 5,104,704 | 4/1992 | Labes et al. | 428/35.7 |
| 5,147,699 | 9/1992 | Browning et al. | 428/40 |
| 5,153,042 | 10/1992 | Indrelie | 428/40 |
| 5,209,698 | 5/1993 | Dolan | 283/81 |

OTHER PUBLICATIONS

3M Brochure for for "Label Stocks", 1989, p. 30 et seq.

*Primary Examiner*—Ellis P. Robinson
*Assistant Examiner*—Nasser Ahmad
*Attorney, Agent, or Firm*—Nixon & Vanderhye

[57] ABSTRACT

A multi-ply business form has a piggyback label assembly with a tamper evident feature. A first adhesive layer engages a top face of the main ply, a release liner covers the first adhesive layer, a second adhesive layer covers the top face of the release liner, and a polyester imprintable film label covers the second adhesive layer. The tamper evident feature of the label may be provided by portions of the label and second adhesive remaining with a first surface to which the label is applied, while the rest of the second adhesive and label releases, the words "VOID" then appearing in the label. The label may have three distinct parts, two strip portions for sealing specimen bottles, and a block portion for sealing a box containing specimen bottles. The first adhesive has more aggressiveness than the second adhesive.

20 Claims, 3 Drawing Sheets

VOID LABEL

BACKGROUND AND SUMMARY OF THE INVENTION

Social conditions have greatly increased the demand for laboratory testing business forms, for such things as drug testing, testing for communicable diseases, and testing for predisposition toward medical problems. It is extremely important for all such testing that the integrity of the specimens tested be maintained and accurate identification of the specimens be provided, otherwise serious consequences can result, including persons who are using drugs working in sensitive jobs, or unfairly competing with others in sporting events; persons who do not use drugs being unfairly discharged; persons with communicable diseases receiving inadequate treatment and potentially infecting those around them; persons with predisposition toward medical conditions not receiving adequate treatment; and persons receiving treatment when they do not really have predisposition toward a medical condition.

In response to the needs identified above, statutory regulations, such as in the United States, have been promulgated which, for certain situations, require the taking of two different specimens, sealing the specimen containers with labels, and then sealing the box in which the specimens are provided. Also, a number of manufacturers have produced labels which have tamper evident features, such as a label produced by 3M of Minneapolis, Minn., identified as Scotchmark® 7385 tamper evident film, and other tamper evident products discussed in the background portion of U.S. Pat. No. 5,153,042.

According to the present invention, a business form is produced which contains a piggyback label having a tamper evident feature, and which complies with statutory provisions relating to proper sealing of specimens and boxes containing the specimens. The business form according to the present invention is ideally suited for testing laboratories, for testing for drugs, infectious diseases, and the like, presenting the multiple label portions that are necessary for statutory compliance, or desirable for maximum utility, so that they are readily associated with printed indicia on the form, allowing easy completion of the form, cross referencing data on the form and labels, and yet providing maximum utility of the label.

According to the present invention a business form is provided comprising the following components: A main paper ply having indicia on a top face thereof. A piggyback label assembly on a portion of the top face of the main ply, spaced from the indicia. The piggyback label assembly comprises: a first adhesive layer engaging the top face of the main ply; a release liner covering the first adhesive layer and having a top face opposite the first adhesive layer; a second adhesive layer covering the top face of the release liner; and a label covering the second adhesive layer; the first adhesive having a much greater affinity for the main paper ply and the release liner than the second adhesive has for the release liner. And wherein at least a portion of the label comprises a tamper evident feature so that once the label portion is removed from the release liner and applied to a surface, when it is removed from the surface the label portion will indicate tampering.

The label preferably is the 3M 7385 label described above, which indicates tampering by portions of the label remaining with portions of the second adhesive on the surface to which it has been applied, while other portions of the label and second adhesive release from the surface. The portions of the label and second adhesive remaining with the surface form the words "VOID" in the release portions of the label.

As required by statute for certain types of labels, for drug testing for example, the label according to the present invention preferably comprises three separate and distinct portions, namely first and second strip portions and a block portion. The strip portions are parallel to each other and have approximately the same size and shape, while the block portion has a different size and shape. The block portion is adjacent the first edge of each of the first and second strips, which edge is in line from one strip to the other. The second edge of the first strip is adjacent the third edge of the second strip portion. The strips typically have indicia on the top face thereof indicating a specimen designation for laboratory testing, while the block portion has indicia indicating application to a box. Preferably all three portions have the tamper evident feature.

Typically the label comprises a polyester imprintable film. The release liner comprises an approximately 55 pound per ream kraft paper, with release coating on the top face thereof, which engages the second adhesive. The first adhesive preferably comprises a high tenacity acrylic adhesive, and the second adhesive comprises a high precision acrylic adhesive, with less aggressiveness than the high tenacity acrylic adhesive.

The business form according to the invention preferably comprises a multi-ply form, that is having at least a second paper ply underlying the main paper ply with image transfer means therebetween (e.g., carbonless coatings, or carbon paper), and typically include as many a seven or eight parts.

It is a primary object of the present invention to provide an efficient and effective business form particularly adapted for allowing ready filling out and utilization of tamper evident labels. This and other objects of the invention will become clear from an inspection of the detailed description of the invention, and from the appended claims.

BRIEF DESCRIPTION OF THE DRAWINGS

FIG. 5 is a top perspective detail view showing removal of the three label portions of the label assembly on the business form of FIG. 3, for use in sealing specimen containers and a box container.

DETAILED DESCRIPTION OF THE DRAWINGS

Figure 1:
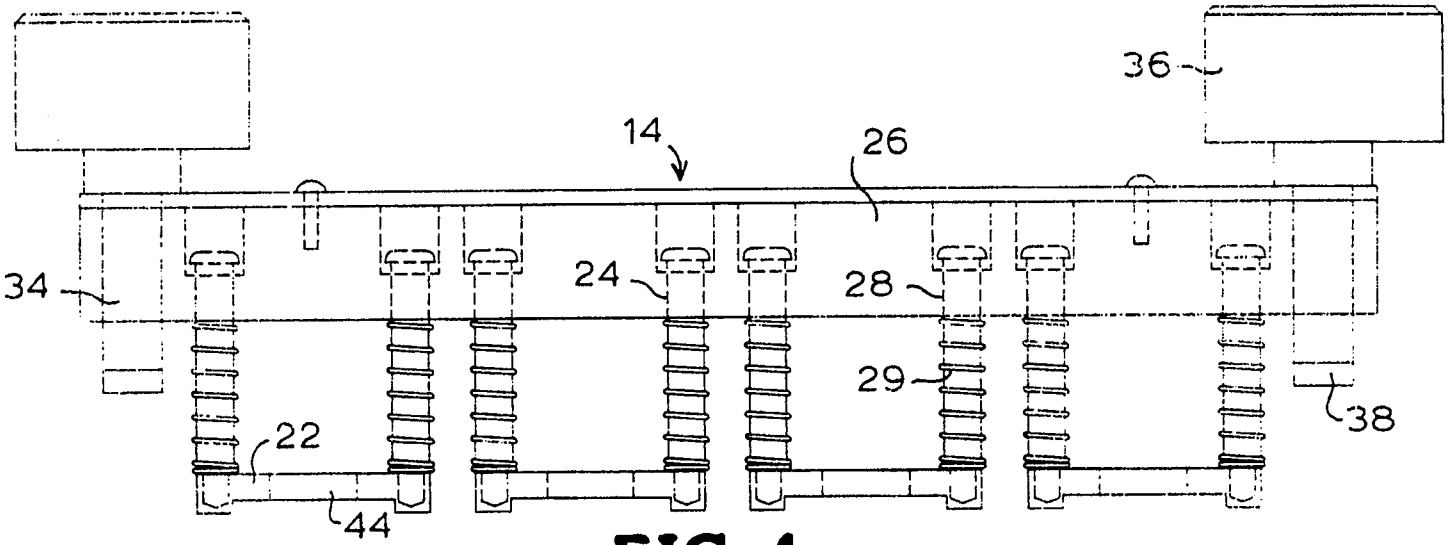
FIG. 1 is a top perspective view of part of a continuous form of printed label assemblies prior to application on the business form according to the invention.

FIG. 1 illustrates a sheet or roll of piggyback labels utilized to manufacture a business form according to the present invention. The assembly of FIG. 1 comprises a release sheet 10 having a release coating on the top face thereof, and a plurality of piggyback label assemblies 11 having dimensions significantly less than the dimensions of the sheet 10 spaced along the length thereof. The assembly 12 of the release sheet 10 and the piggyback labels 11 is fed to a conventional machine for blowing on labels to business forms.

Figure 2:
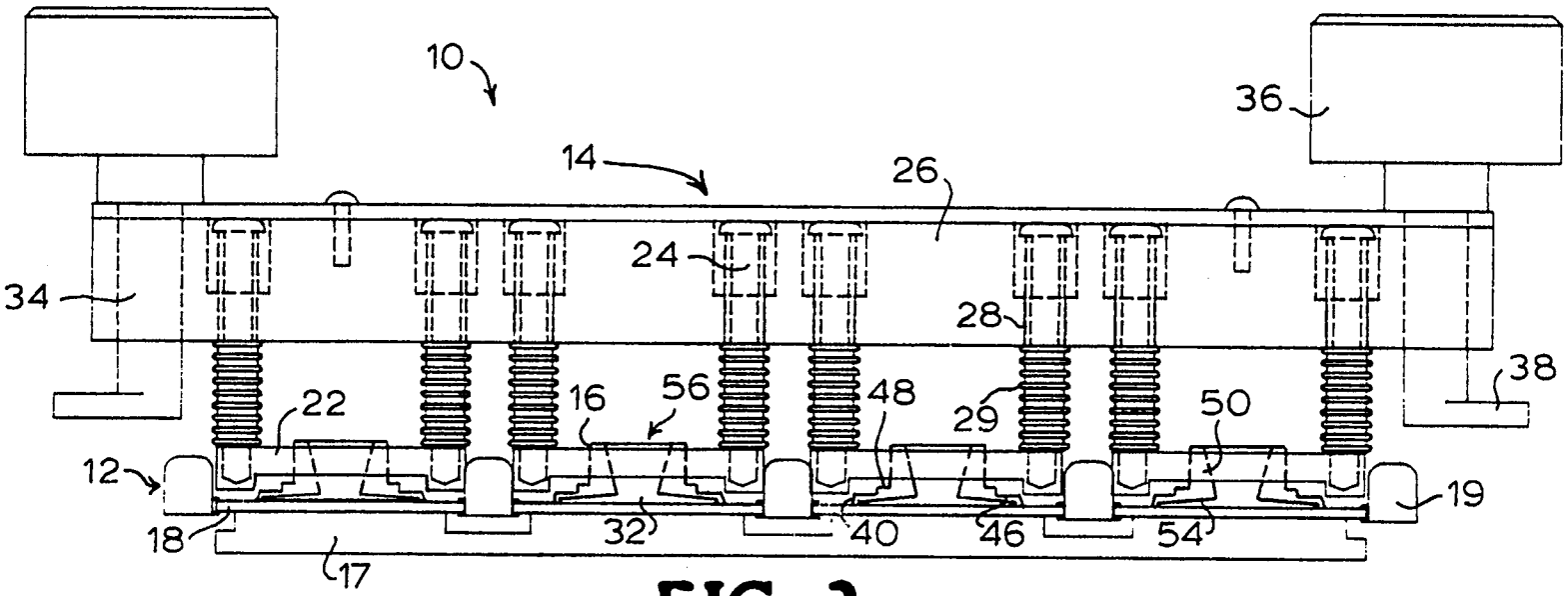
FIG. 2 is a cross sectional view of the label assembly of FIG. 1 taken along lines 2—2 thereof.

As seen in FIG. 2, the assembly 11 comprises a 3M 7385 "Scotchmark" label assembly including a first adhesive 13 which is applied to the top, release coated, face of the large release liner 10. The first adhesive 13 may comprise a high tenacity acrylic adhesive. On top of the first adhesive 13 is a release liner 14 having a top face 15. Engaging the top face 15 of the release liner 14 is the second adhesive layer 16. The second adhesive 16 may comprise a high precision acrylic adhesive, with less aggressiveness than the high tenacity acrylic adhesive 13. On top of the second adhesive 16 is a label 18.

In the preferred embodiment according to the present invention, a label 18, as most clearly seen in FIGS. 1 and 5, comprises three portions, a first strip portion 19, a second strip portion 20, and a lock portion 21. The strip portions 19, 20 are parallel to each other until removed (see FIG. 1) and are of approximately the same size and shape, each having a first edge 22 which is adjacent an edge 23 of the block portion 21. The first strip portion has a second edge 24 which is adjacent a third edge 25 of the second strip 20.

The strips 19, 20 preferably have indicia thereon indicating a specimen designation for laboratory testing, and complying with U.S. statutory requirements. For example, the strip 19 may have indicia "specimen A" thereon indicated generally by reference numeral 26, while the strip 20 has the designation "specimen B" thereon indicated by reference numeral 27. Also, there are other printed indicia portions indicating the function of the strip (e.g. see the "bottle seal" indicia 28), as well as blank spaces for the donor's name or social security number, the donor's initials, the date, etc., indicated schematically by reference numerals 29 in FIGS. 1 and 5. The block portion 21 also has indicia thereon, indicating its function—such as application to a box—indicated schematically at 30 in FIGS. 1 and 5, as well as any other indicia such as instructional indicia 31 indicating the place a line 34 printed on the top face of the label portion 21 over the edge of a box.

While a wide variety of different constructions may be provided for the components illustrated in FIG. 2, of the assembly 12, the characteristics of the preferred 3M 7385 "Scotchmark" tamper evident film is as follows: The release liners 10, 14 both have a release coating on only the top face thereof, and are 55 pound (that is have a weight of 55 pounds per ream) densified kraft paper. The label 18 comprises a white tamper evident polyester imprintable film with a void feature. Part of the film may be colored with a different color, such as the portion of each of the strips 19, 20 containing the indicia 26–29. The adhesives 13, 16 are as described above.

Figure 3:
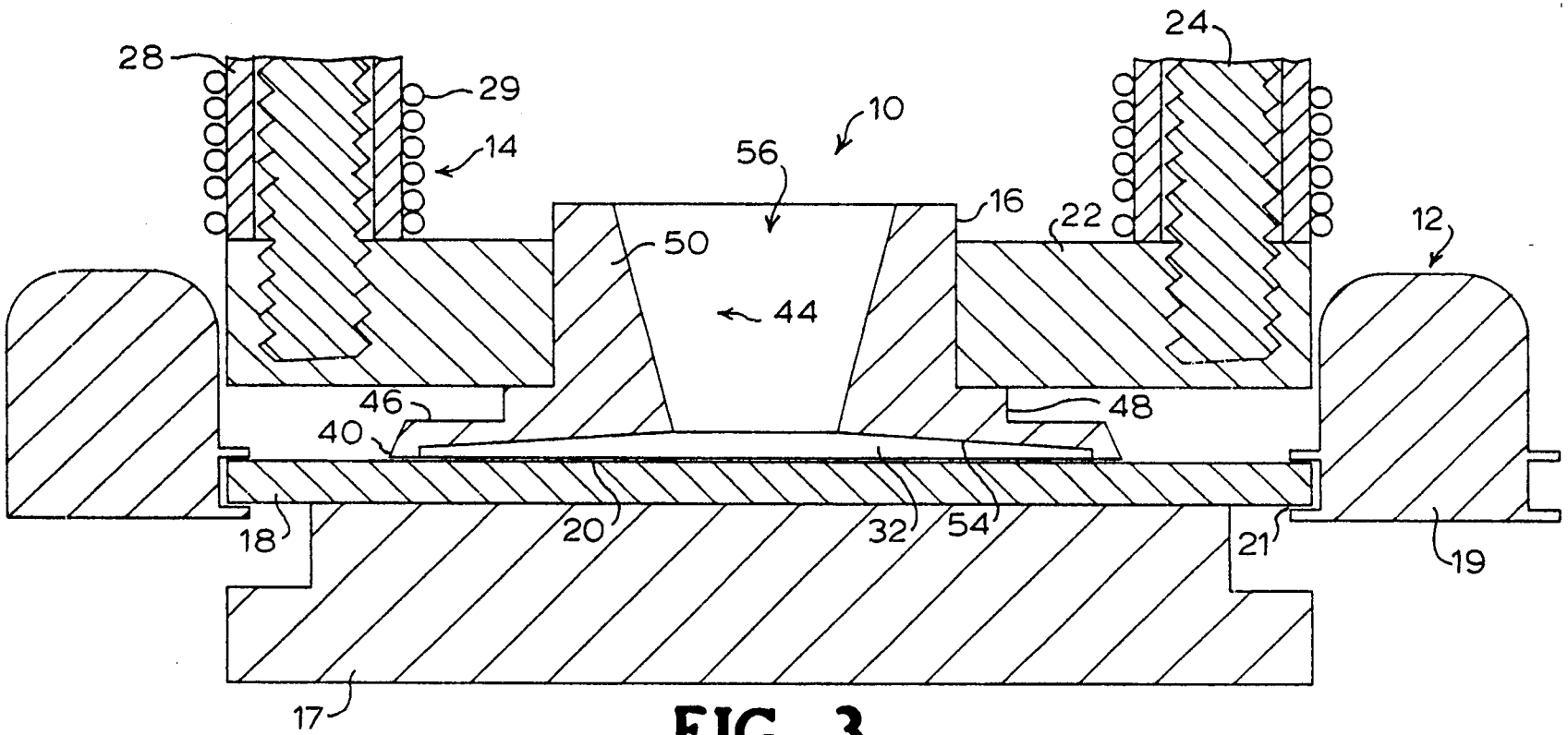
FIG. 3 is a top perspective view of an exemplary business form according to the present invention, in continuous format, with one of the label assemblies of FIG. 1 applied thereto.
Figure 3:
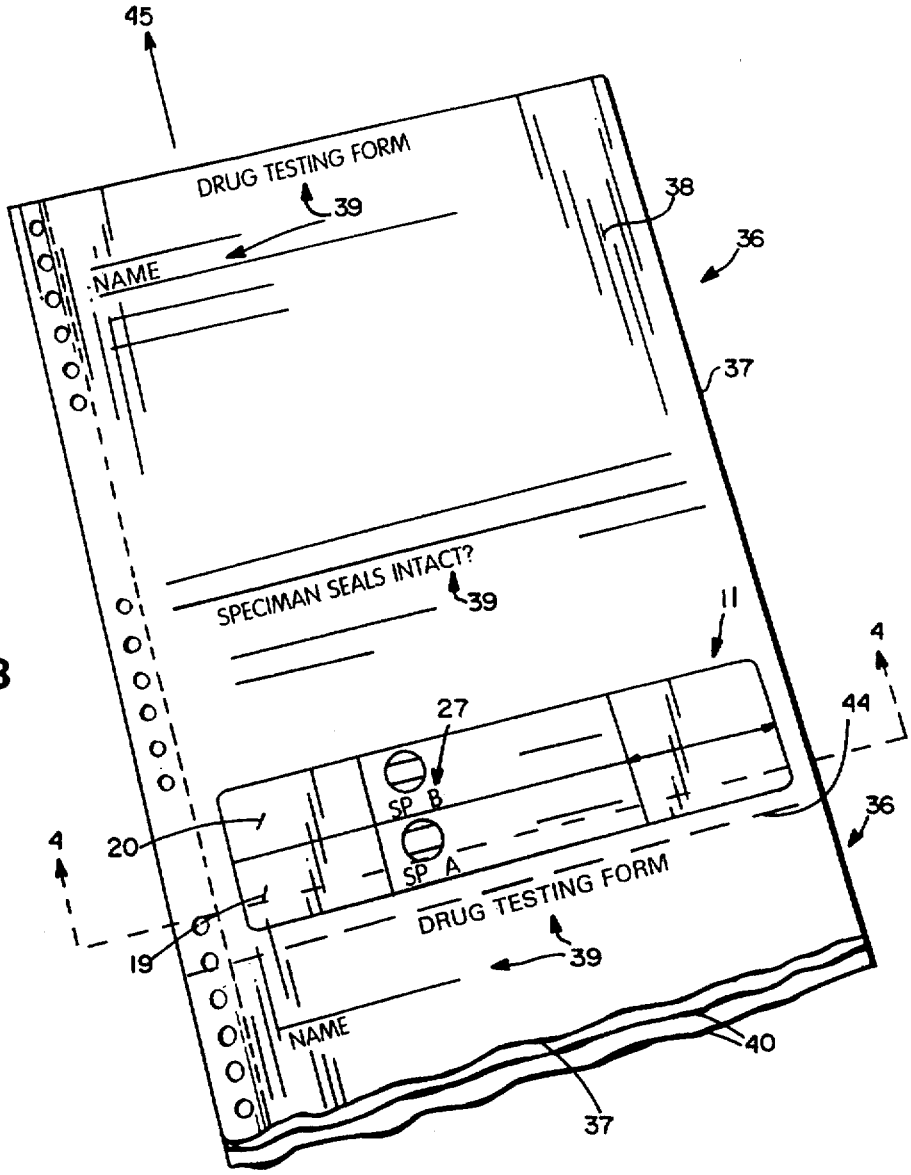
Figure 4:
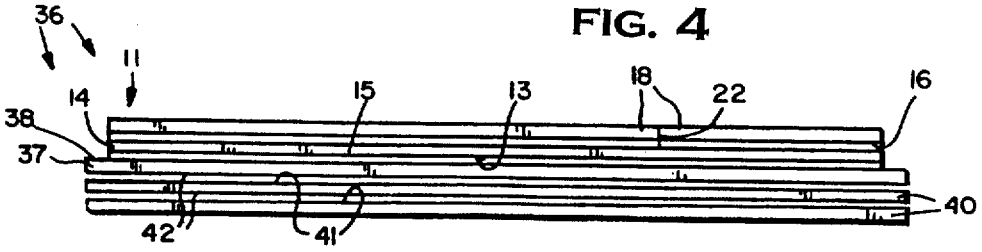
FIG. 4 is a cross sectional view of the business form of FIG. 3 taken along lines 4—4 thereof.

FIGS. 3 and 4 illustrate an exemplary business form 36 according to the present invention. The form 36 includes a main paper ply 37 having a top face 38 with indicia 39 printed thereon. The indicia 39 preferably is indicia related to laboratory testing of specimens, such as having a title indicating that (i.e. "Drug Testing Form" in the embodiment illustrated in FIG. 3), a place for the name, social security number, or other identifying characteristics of the person for whom the laboratory testing is being accomplished, or who supplied the specimens, and indicia indicating whether or not the specimen seals were intact before testing began. Preferably the form 36 is a multi-ply form having at least one other paper ply 40 underlying the main ply 37, with image transfer means between the plies for transferring images provided on the main ply top face 38 to the underlying plies 40. The image transfer means may, as schematically illustrated in FIG. 4, comprises CF coatings 41, and CB coatings 42, or like carbonless coatings; or carbon sheets. The business form 36 may be in continuous format, as illustrated in FIG. 3, separated by perforation lines 44 perpendicular to the direction of movement 45 as the forms 36 are processed through a computer, or removed from a container for individual use.

The business form 36 also comprises a piggyback label assembly 11 on a portion of the top face 38 of the main ply 37, spaced from the indicia 39. The piggyback label assembly 11 has been removed from the large release liner 10 of FIGS. 1 and 2 and blown onto the top face 38 of the main ply 37 by conventional equipment. Therefore, as illustrated in FIG. 4, the first adhesive layer 13 engages the top face 38 of the main paper ply 37 and holds the rest of the components 14, 16, 18 in place. When so applied, the first adhesive 13 has a much greater affinity for the main paper ply 37 and for the release liner 14 bottom face than the second adhesive 16 has for the top face 15 of the release liner 14. Also, of course, the adhesive 16 has a much greater affinity for the label 18 than for the top surface 15 of the release liner 14.

FIG. 5 illustrates removal of the label portions 19–21 of the label assembly 11, peeling away from the top surface 15 of the release liner 14. The strip portions 19, 20 are applied to specimen containers (e.g. having urine, blood, or a like testing fluid therein), such as a bottle 47 illustrated in FIG. 6, while the block portion 21 is applied over a box containing the containers, e.g. (47) sealed by the strips 19, 20, for example the line indicia 34 being provided over the edge of the box containing specimen containers (e.g. 47).

Figure 6:
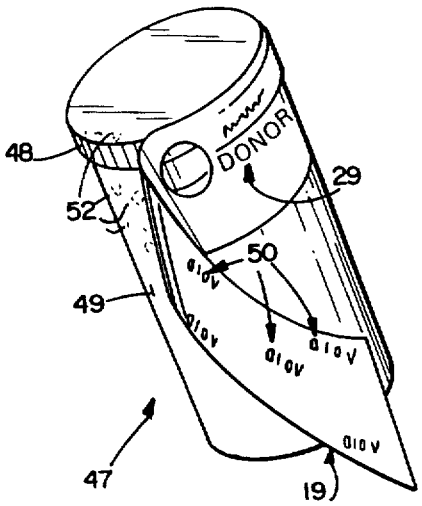
FIG. 6 is a top perspective view illustrating appearance of the void feature in one of the label portions from FIG. 5 after it has been applied to, and then partially removed from, a specimen container.

FIG. 6 illustrates the first strip portion 19 after it has been moved into contact with surfaces of the container 47, for example being placed over the cap 48, and then into contact with a side wall 49 of the container 47, so that the adhesive 16 thereof firmly engages the container 47 portions, and then partially removed. As schematically illustrated by the "VOID" indications 50 in FIG. 6, the label portion 19 is clearly tamper evident, telling anyone who will be using the container 47 that the label portion 19 has been removed before even if it is resealed, and thus indicating that the liquid specimen within the container 47 is unacceptable for testing. For the particular tamper evident label described above in the preferred embodiment, namely the 3M 7385 "Scotchmark" label, this tamper evident feature is provided by portions of the label 19 (such as a primer applied to a face stock, as described in the background portion of U.S. Pat. 5,153,042) and portions of the second adhesive 16 remaining with the surface to which they have been applied, while the majority of the label and second adhesive release from the surface. For example, as seen in FIG. 6, the portions 52 remain on the side wall 49 and cap 48 surfaces of the specimen container 47, comprising both part of the adhesive 16 and "primer" or another portion of the label 19, while the vast majority of the label 19 is peeled away. The remaining portions 52 are what provide the "VOID" indicia 50 in the stripped off portions of the label 19.

It will thus be seen that according to the present invention a business form is provided which conveniently presents a tamper evident label, such as a multi-portion label for specimens, and allows easy completion of information both on the form, and the label. While the invention has been herein shown and described in what is presently conceived to be the most practical and preferred embodiment, it will be apparent to those of ordinary skill in the art that many modifications may be made thereof within the scope of the invention, which scope is to be accorded the broadest interpretation of the appended claims so as to encompass all equivalent structures and assemblies.

What is claimed is:

1. A business form with label consisting essentially of:

a multilayered main paper ply assembly having indicia on a topmost face thereof;

a multipart label assembly on a portion of said top face of said main ply, spaced from said indicia;

said label assembly consists essentially of: a first adhesive layer engaging said top face of said main ply; a release liner covering said first adhesive layer and having a top face opposite said first adhesive layer; a second adhesive layer covering said top face of said release liner; and a label covering said second adhesive layer; said first adhesive having a much greater affinity for said main paper ply assembly topmost face and said release liner than said second adhesive has for said release liner so that if a force is applied to said label said second adhesive will release from said release liner before said first adhesive will release; and wherein at least a portion of said label comprises a tamper evident feature so that once said label portion is removed from said release liner and applied to a surface, when it is removed from the surface said label portion will indicate tampering.

2. A business form as recited in claim 1 wherein said label indicates tampering when removed from a surface to which it has been applied by portions of said label remaining with portions of said second adhesive which remains with the surface, while other portions of said label and second adhesive release from the surface.

3. A business form as recited in claim 2 wherein said portions of said label and second adhesive remaining with the surface form the words VOID in said release portions of said label.

4. A business form as recited in claim 3 wherein said label comprises three distinct, separate portions, a first strip portion, a second strip portion parallel to and approximately the same size and shape as said first strip portion, and a block portion having a different size and shape than said first and second strip portions, said block portion adjacent a first edge of each of said first and second strip portions, a second edge of said first strip portion adjacent a third edge of said second strip portion, and said first edges of said first and second strip portions in line with each other.

5. A business form as recited in claim 4 wherein said strip portions each have indicia on a top face thereof indicating a specimen designation for laboratory testing.

6. A business form as recited in claim 5 wherein said block portion has indicia indicating application to a box.

7. A business form as recited in claim 5 wherein said first and second strip portions have said tamper evident feature.

8. A business form as recited in claim 6 wherein said block portion also has said tamper evident feature.

9. A business form as recited in claim 1 wherein said label comprises three distinct, separate portions, a first strip portion, a second strip portion parallel to and approximately the same size and shape as said first strip portion, and a block portion having a different size and shape than said first and second strip portions, said block portion adjacent a first edge of each of said first and second strip portions, a second edge of said first strip portion adjacent a third edge of said second strip portion, and said first edges of said first and second strip portions in line with each other.

10. A business form as recited in claim 9 wherein said strip portions each have indicia on a top face thereof indicating a specimen designation for laboratory testing.

11. A business form as recited in claim 1 wherein said main paper ply assembly comprises a main paper ply and at least one more paper ply underlying said main paper ply, and image transfer means between said paper plies for transferring images provided on said main ply top face to said underlying plies.

12. A business form as recited in claim 1 wherein said label comprises a polyester imprintable film.

13. A business form as recited in claim 1 wherein said release liner comprises an approximately 55 pound per ream densified kraft paper with release coating on said top face thereof, engaging said second adhesive.

14. A business form as recited in claim 1 wherein said first adhesive comprising a high tenacity acrylic adhesive, and wherein said second adhesive comprises a high precision acrylic adhesive, with less agressiveness than said high tenacity acrylic adhesive.

15. A business form with label comprising:

a multilayered main paper ply having indicia on a top face thereof;

a multipart label assembly on a portion of said top face of said main ply, spaced from said indicia;

said label assembly comprising: a first adhesive layer engaging said top face of said main ply; a release liner covering said first adhesive layer and having a top face opposite said first adhesive layer; a second adhesive layer covering said top face of said release liner; and a label covering said second adhesive layer; said first adhesive having a much greater affinity for said main paper ply and said release liner than said second adhesive has for said release liner so that if a force is applied to said label said second adhesive will release from said release liner before said first adhesive will release;

wherein at least a portion of said label comprises a tamper evident feature so that once said label portion is removed from said release liner and applied to a surface, when it is removed from the surface said label portion will indicate tampering; and wherein said label comprises three distinct, separate portions, a first strip portion, a second strip portion parallel to and approximately the same size and shape as said first strip portion, and a block portion having a different size and shape than said first and second strip portions, said block portion adjacent a first edge of each of said first and second strip portions, a second edge of said first strip portion adjacent a third edge of said second strip portion, and said first edges of said first and second strip portions in line with each other.

16. A business form as recited in claim 15 wherein said strip portions each have indicia on a top face thereof indicating a specimen designation for laboratory testing.

17. A business form as recited in claim 16 wherein said block portion has indicia indicating application to a box.

18. A business form as recited in claim 16 wherein said first and second strip portions have said tamper evident feature.

19. A business form as recited in claim 18 wherein said block portion also has said tamper evident feature.

20. A business form as recited in claim 16 wherein said main paper ply assembly indicia comprises indicia related to laboratory testing of specimens.

* * * * *

UNITED STATES PATENT AND TRADEMARK OFFICE

CERTIFICATE OF CORRECTION

PATENT NO. : 5,346,739
DATED : Sept. 13, 1994
INVENTOR(S) : Gary J. Nassoiy

It is certified that error appears in the above-identified patent and that said Letters Patent is hereby corrected as shown below:

The drawing sheets, consisting of Figs. 1, 2, and 3 should be deleted to be replaced with the drawing sheets, consisting of Figs. 1-6, as shown on the attached pages.

Signed and Sealed this

Twenty-first Day of March, 2000

*Attest:*

*Attesting Officer*

Q. TODD DICKINSON

*Commissioner of Patents and Trademarks*

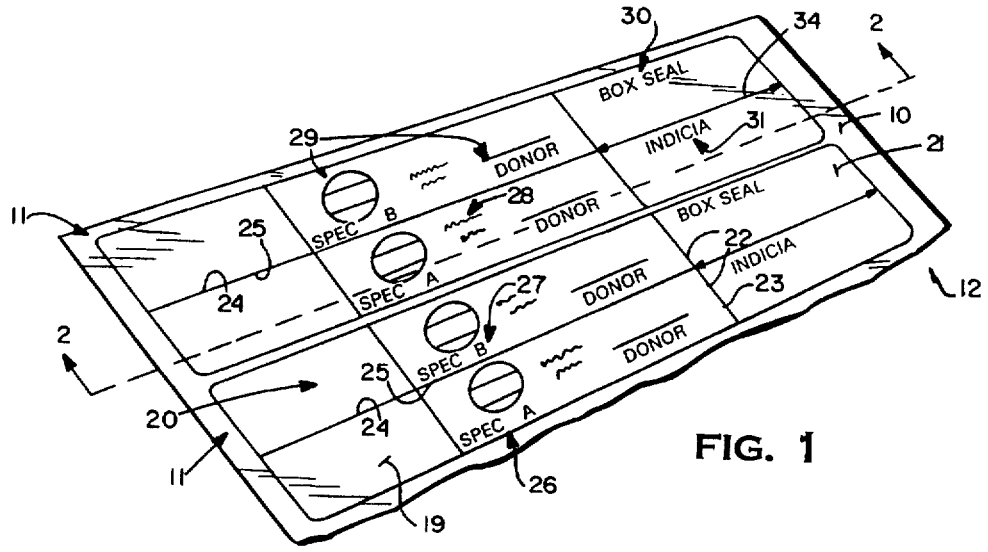
FIG. 1
FIG. 2
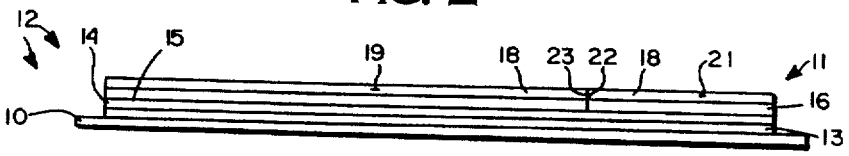
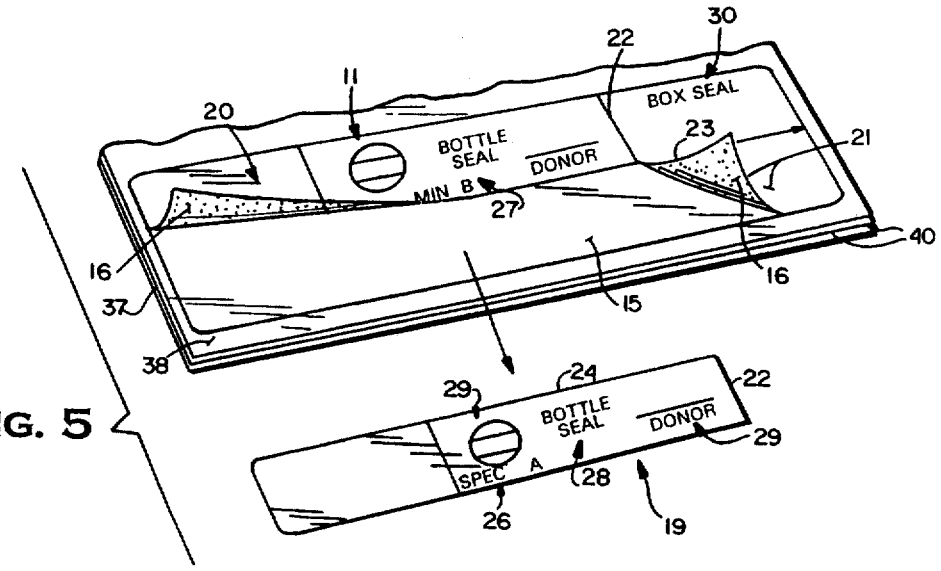
FIG. 5